US012629573B1

(12) United States Patent
Hoffarth et al.

(10) Patent No.: US 12,629,573 B1
(45) Date of Patent: May 19, 2026

(54) GOLF CLUB HEAD WITH A WEIGHT CHANNEL PUCK

(71) Applicant: Topgolf Callaway Brands Corp., Carlsbad, CA (US)

(72) Inventors: Brian Hoffarth, Carlsbad, CA (US); Dominic D. DeMille, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 304 days.

(21) Appl. No.: 18/383,288

(22) Filed: Oct. 24, 2023

Related U.S. Application Data

(60) Provisional application No. 63/420,773, filed on Oct. 31, 2022.

(51) Int. Cl.
*A63B 53/04* (2015.01)
*A63B 53/06* (2015.01)
*A63B 60/00* (2015.01)

(52) U.S. Cl.
CPC ..... *A63B 53/06* (2013.01); *A63B 53/0433* (2020.08); *A63B 60/002* (2020.08); *A63B 2053/0491* (2013.01); *A63B 2209/00* (2013.01)

(58) Field of Classification Search
CPC ..... A63B 2053/0491; A63B 53/0433; A63B 60/002
See application file for complete search history.

(56) References Cited

U.S. PATENT DOCUMENTS 6,089,994 A * 7/2000 Sun ..... A63B 60/02 473/341
2003/0032499 A1* 2/2003 Wahl ..... A63B 53/047 473/334
2018/0178092 A1* 6/2018 Johnson ..... A63B 53/06

* cited by examiner

*Primary Examiner* — Raeann Gorden
(74) *Attorney, Agent, or Firm* — Michael A. Catania; Daniel Moderick

(57) ABSTRACT

A golf club head having a channel with a puck therein is disclosed herein. The puck comprises a weight. The channel is within the sole of the golf club head. A stiffening member is also positioned over the channel.

1 Claim, 10 Drawing Sheets

GOLF CLUB HEAD WITH A WEIGHT CHANNEL PUCK

CROSS REFERENCES TO RELATED APPLICATIONS

The Present Application claims priority to U.S. Provisional Patent Application No. 63/420,773, filed on Oct. 31, 2022, which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention relates to a golf club head with a channel and having a weight channel puck.

Description of the Related Art

The center of gravity (CG) of a golf head is crucial to its performance because it affects the spin and launch profile of a golf ball as it leaves the golf head. Because of this, adjustability in the perimeter weighting of a golf head can provide great benefits to the golfer. Interchangeable weights can be used to achieve these performance benefits, as can the inclusion of one or more moveable weights in or on a track/channel to provide additional CG adjustment options. However, the geometry of a channel or track, and in particular the thin-walled, pocket-type structure, can lead to low frequency vibrations shortly after the impact, which are linked to an unappealing sound after the ball leaves the club head.

On almost every driver with a slider channel, ribs are added to the inner molding line (IML) to help stiffen the channel and improve acoustics. While investigating the reinforcement of the slider track, it was found that the acoustics were very sensitive to stiffening features on the outer molding line (OML) of the clubhead/track. While these features have the potential to be more efficient than the internal ribs, they impede the functionality of the track itself, or in other cases they might make the casting process more difficult and/or costly.

Prior art golf club heads, such as the one shown in FIGS. 1-5, have addressed the problem with sound through the inclusion of internal ribs 50, which stiffen a portion of the golf club head on or around the channel 60. Unfortunately, this internal rib 50 structure moves mass away from the periphery of the golf club head, which can negatively affect the mass properties of the club. This configuration also hides important technology from the view of the golfer.

Therefore, there is a need for a golf club head with improved structures that allow for weight adjustability without negatively affecting sound upon impact with a golf ball.

BRIEF SUMMARY OF THE INVENTION

One other option to help with acoustics, while stiffening the track from the OML would be to use a lightweight puck to fill a channel-like feature in the sole or ribbon of a driver or fairway. The lightweight puck could have discrete pockets in which to place high density weights and the puck could be either permanently attached to the body via adhesive or mechanically fastened for further adjustability. If the track was transparent or translucent, the user would be able to tell where the weights are without having to remove the entire puck-weight(s) assembly.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is directed to a golf club head 10 with a channel 60 sized to receive one or more adjustable weights through clamping attachment to one or more structures 61, 63 disposed within the channel 60, and an external support structure that bridges, and thereby supports, the channel 60 without unduly interfering with weight adjustment. The channel 60 may have one or more of the feature of the tracks, slots, and channels shown in U.S. Pat. Nos. 8,894,506, 8,696,491, 9,211,453, 9,623,302, 9,682,299, 9,724,577, 9,731,178 and 9,981,165, the disclosure of each of which is hereby incorporated in its entirety herein. Placement of a support structure, which includes one or more stiffening members 70, on the exterior of the golf club head is a more mass efficient solution than prior art configurations intended to improve sound quality, particularly attenuation of lower frequency mode shapes associated with slider track geometry. The support structure of the present invention also reduces the amount of mass required to have this sound-improving effect when compared with prior art golf club heads, prior art shown in FIGS. 1-5.

Figure 16:
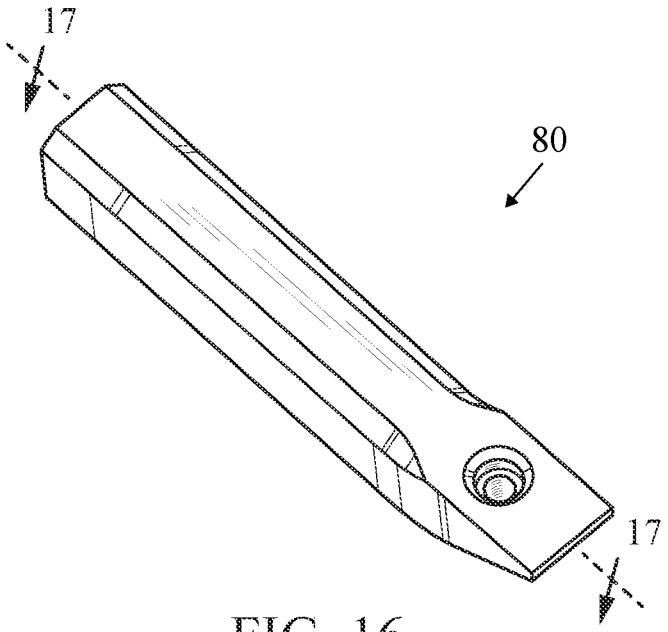
FIG. 16 is an isolated view of a puck.
Figure 17:
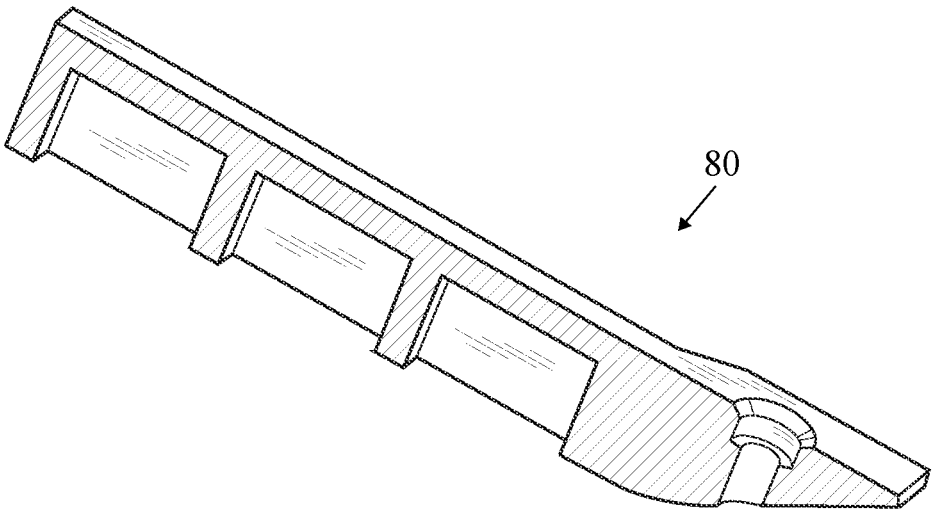
FIG. 17 is a cross-sectional view of the puck of FIG. 16.
Figure 18:
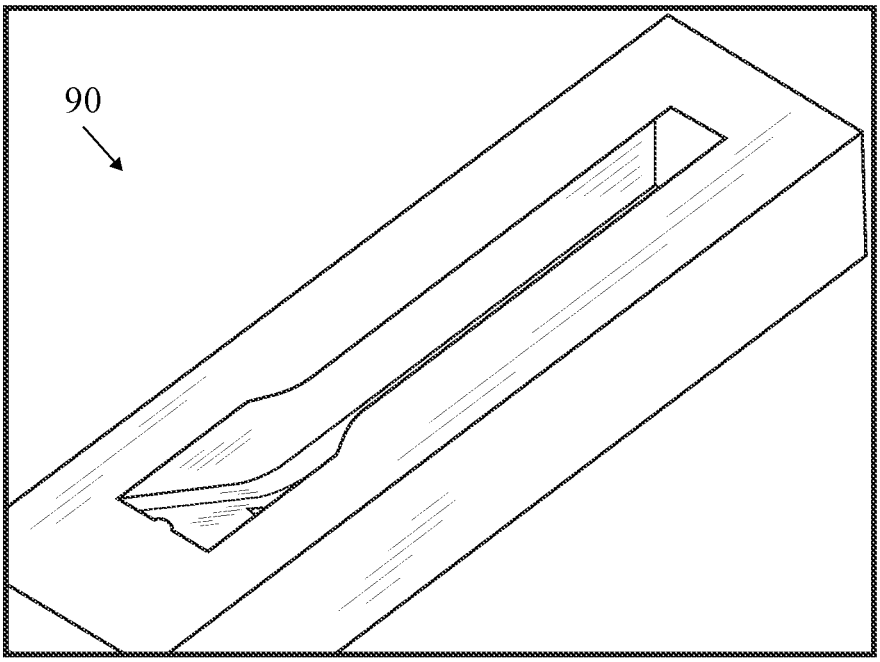
FIG. 18 is an isolated view of a testing track for a puck.

The puck 80, shown in FIGS. 16-17, could be traditionally made via injection molding of thermoplastics, compression molding of composites, or made via additive manufacturing, which would allow for some complex lattice structures for further light weighting. FIG. 17 is a cross-sectional view of the puck 80. FIG. 18 shows a testing track 90 for a puck 80.

Another possible benefit would potentially allow for further weight savings by selectively removing some of the titanium channel walls. If placed correctly, some number of holes or cutouts of the titanium channel might be possible. With the puck covering the channel the holes wouldn't be considered openings or through holes and the club design would still be conforming.

Figure 6:
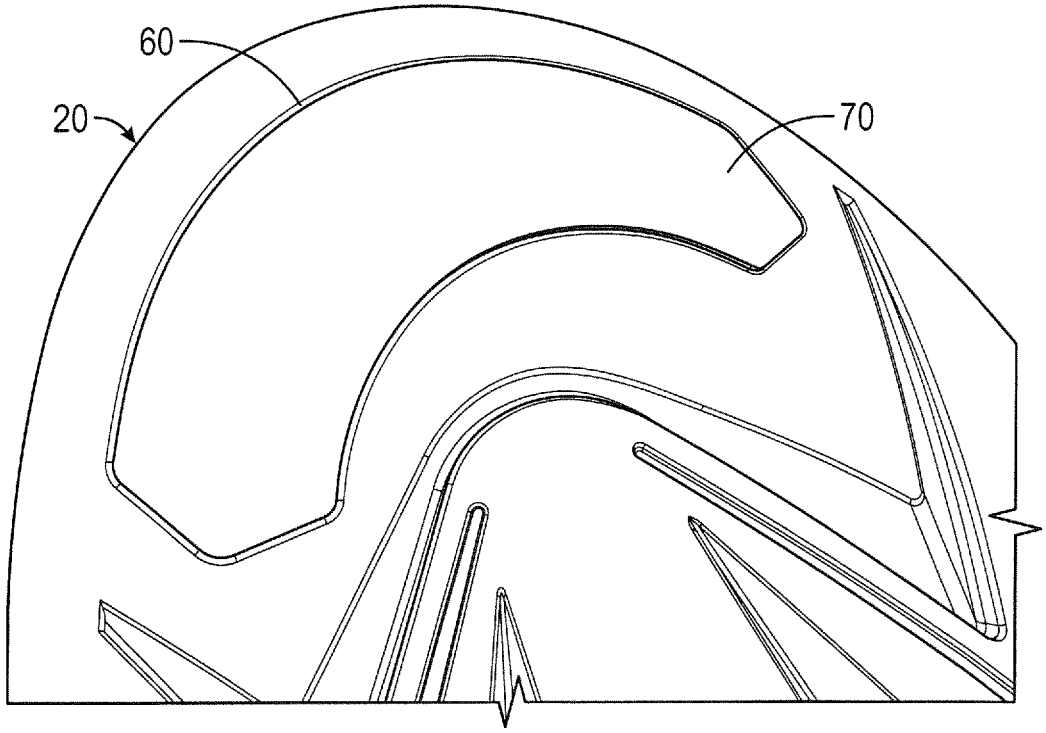
FIG. 6 is a sole perspective views of a golf club head with a channel, with a support structure.
Figure 7:
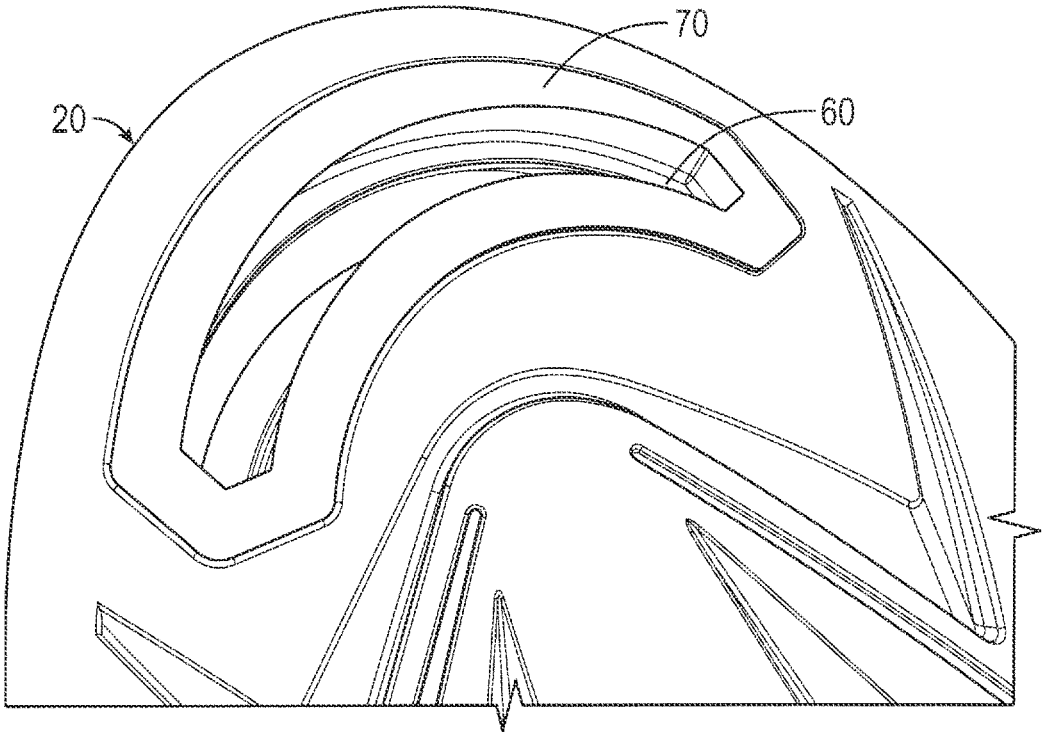
FIG. 7 is a sole perspective views of a golf club head with a channel, with an open support structure.
Figure 8:
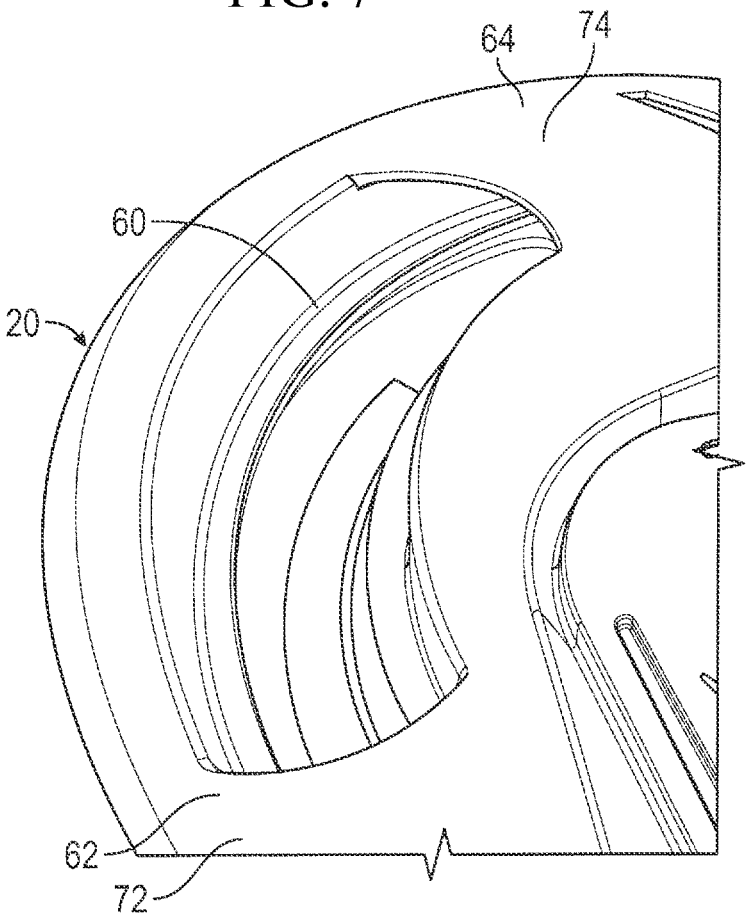
FIG. 8 is a sole perspective view of a golf club head.

Two different support strategies for reinforcement of the channel 60 are shown in FIGS. 6-7, with FIG. 6 having a support structure comprising a single stiffening member 70 covering or bridging the entire area of the channel 60, and FIG. 7 having a support structure comprising a single stiffening member 70 covering or bridging only the edges of the channel 60. The embodiments of the present invention use the strategy disclosed in FIG. 7 so that the interior of the channel 60 is at least partially accessible to the golfer so that they can move weights within it. FIG. 8 shows the channel 60 without the support structure, the stiffening member 70.

Figure 1:
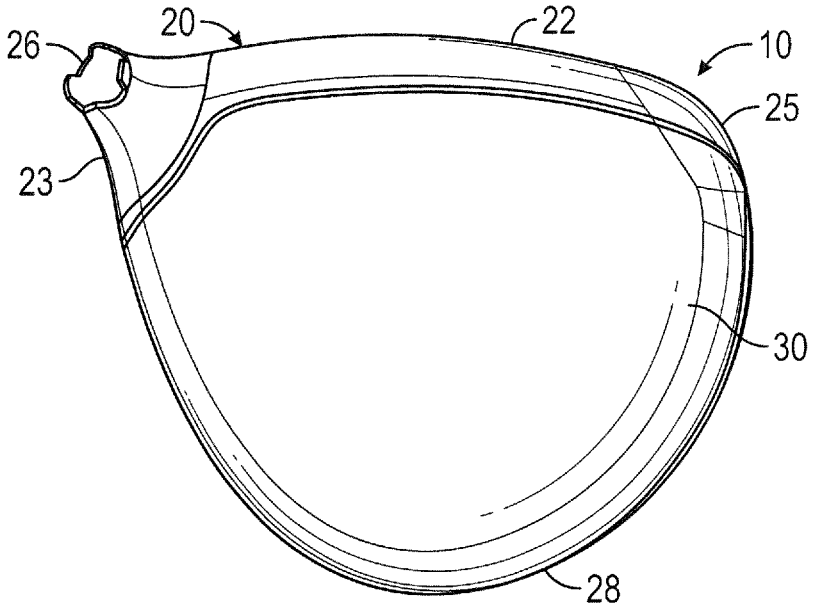
FIG. 1 (PRIOR ART)
FIG. 1 is a top plan view of a prior art golf club head.
Figure 2:
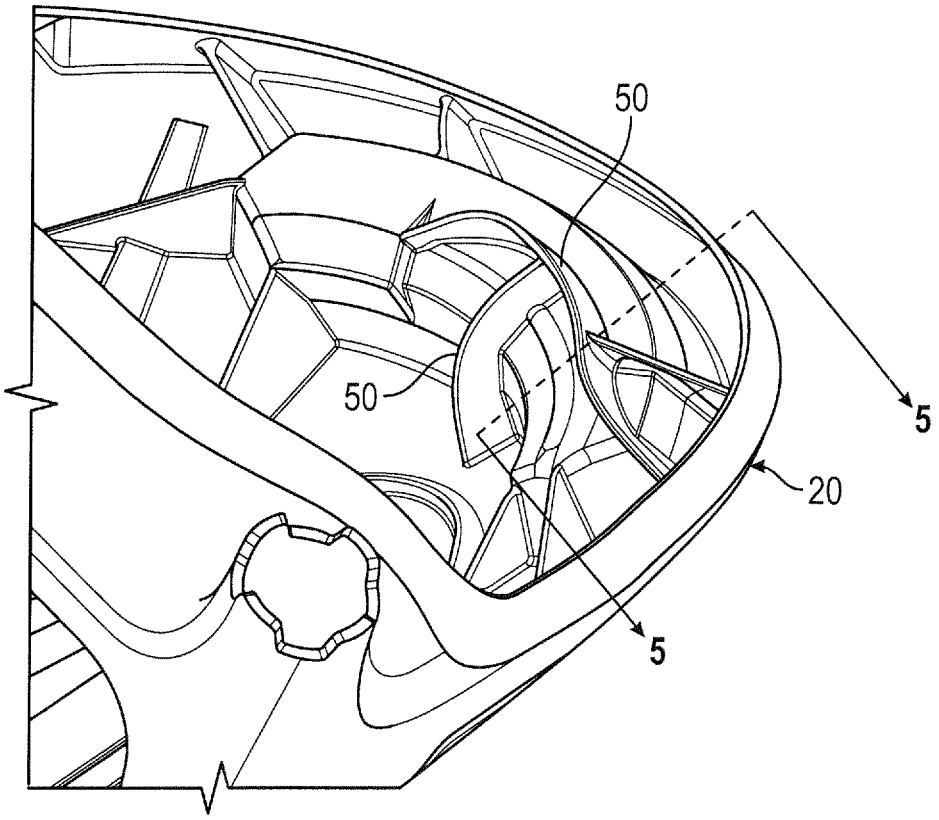
FIG. 2 (PRIOR ART)
FIG. 2 is a side perspective view of the embodiment shown in FIG. 1 with its face and crown inserts removed.
Figure 3:
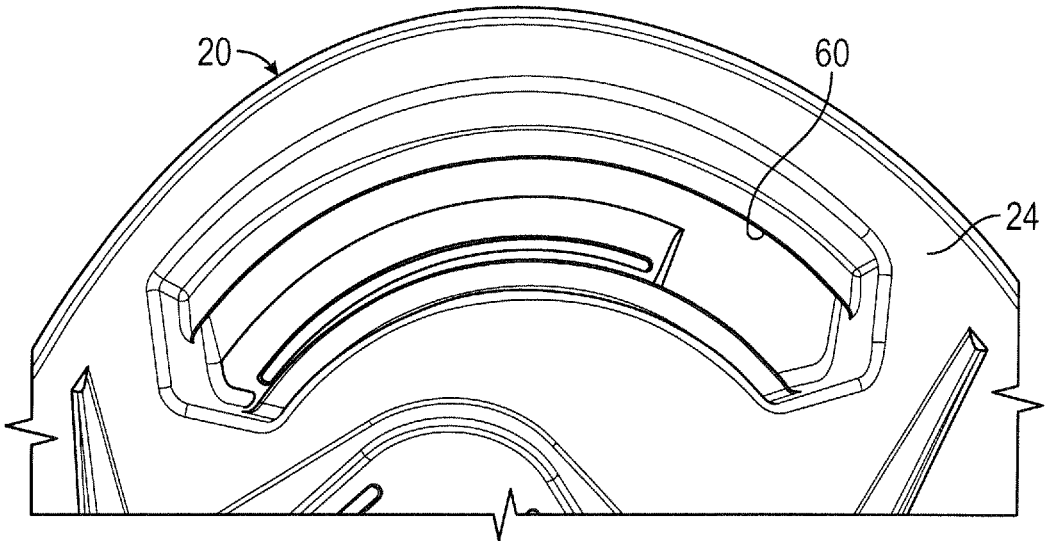
FIG. 3 (PRIOR ART)
FIG. 3 is a sole plan view of the channel shown in FIG. 2.
Figure 4:
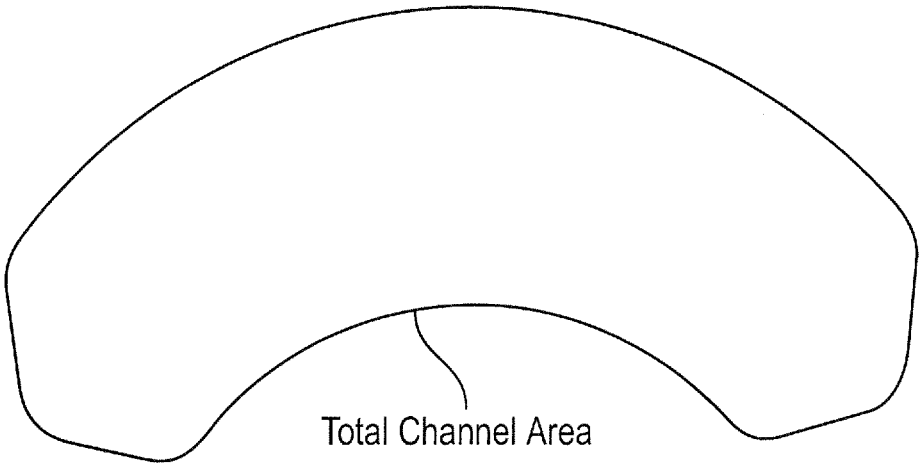
FIG. 4 (PRIOR ART)
FIG. 4 is an illustration of the area of the channel shown in FIG. 2.
Figure 5:
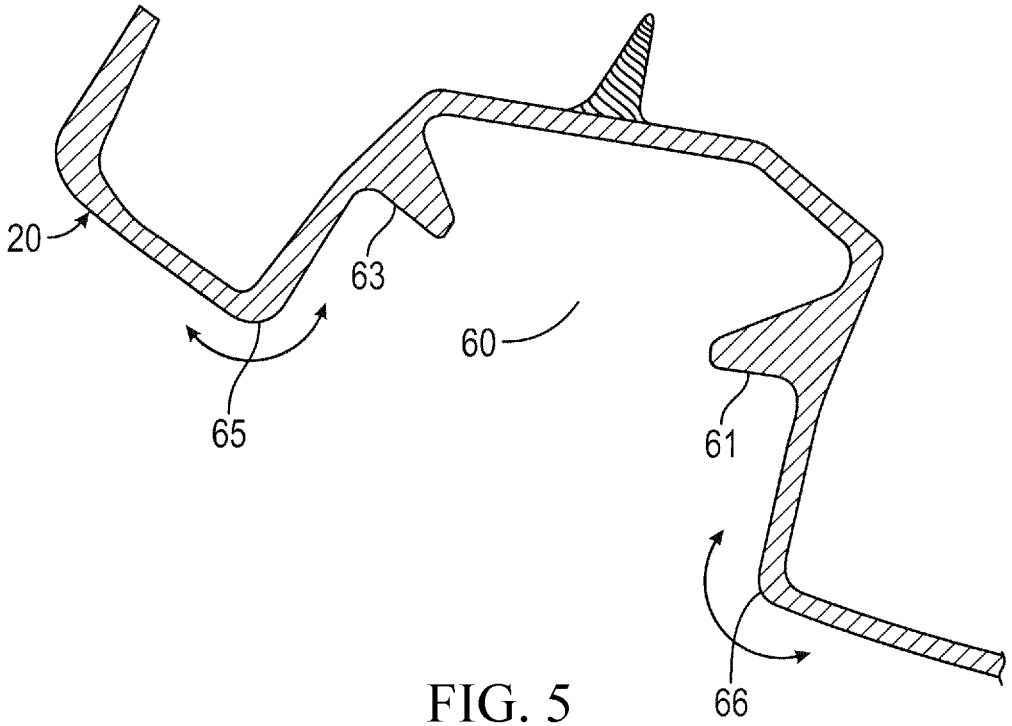
FIG. 5 (PRIOR ART)
FIG. 5 is a cross-sectional view of the channel shown in FIG. 3 taken along lines 5-5.

Mode shapes associated with the channel 60 are typically linked to the movement of the hinges 65, 66 of the channel 60 as shown by the arrows in FIG. 5. Generally speaking, low frequency fundamental mode shapes, when excited with a short impulse from a golf ball impact, tend to be loud and unappealing to golfers. Adding external stiffening members 70 that bridge the channel 60 increases the compliance of the channel 60, thus preventing any low frequency mode shapes. Since these members 70 are very effective at stiffening the structure, they offer a solution that is much lighter than use of multiple conventional ribs 50 on the inside of the golf club head 10.

In any of the embodiments shown herein, the golf club head 10 has a face 22, sole 24, crown 30 (usually a separate piece made of composite), a heel side 26, a hosel 23, a toe side 25, and a rear side 28. The channel 60 of the present invention is preferably located in the sole 24 of the body 20 proximate the rear side 28, but in alternative embodiments it may be located elsewhere on the golf club head 10.

Figure 9:
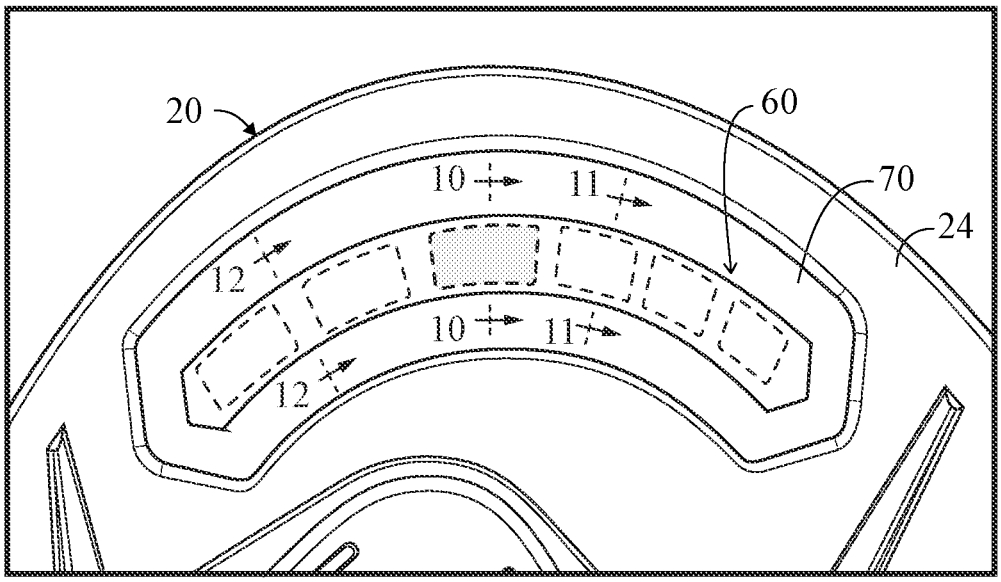
FIG. 9 is a bottom view of a golf club head with a channel and a puck with a weight therein.
Figure 10:
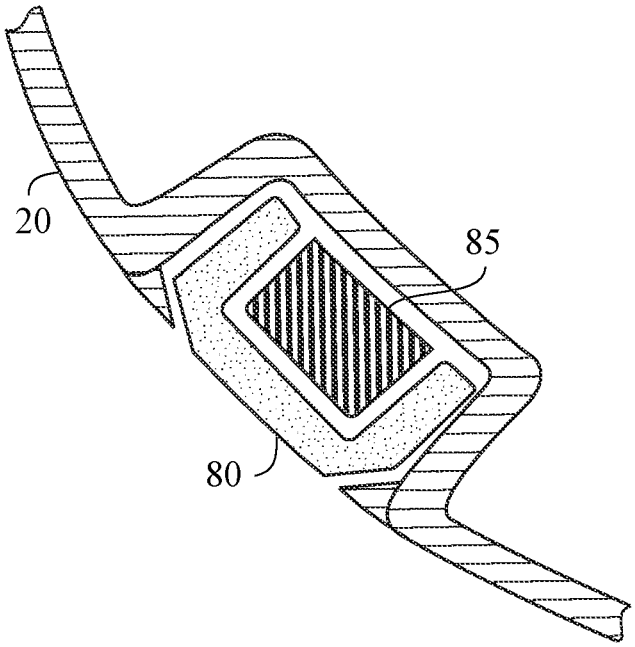
FIG. 10 is a cross-sectional view along line 10-10 of FIG. 9.
Figure 11:
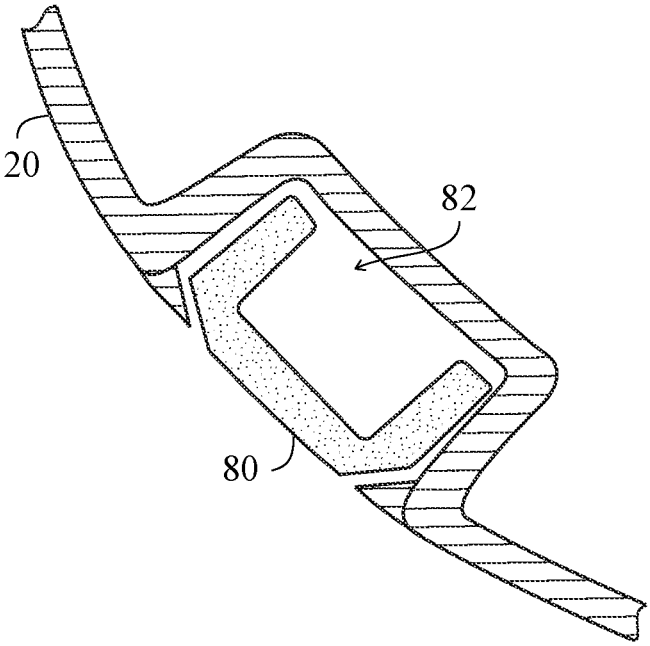
FIG. 11 is a cross-sectional view along line 11-11 of FIG. 9.
Figure 12:
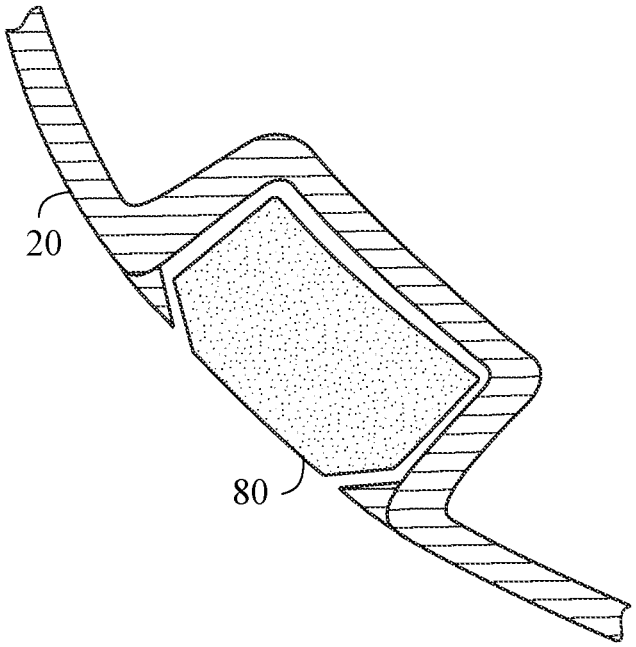
FIG. 12 is a cross-sectional view along line 12-12 of FIG. 9.

FIG. 9 is a sole 24 view with a channel 60 and a puck 80 with a weight 85 therein. FIGS. 10-12 are cross-sectionals showing the puck 80 and the interior. In FIG. 10, a weight 85 is present in the pocket 82 of the puck 80. In FIG. 11, the pocket 82 is empty. FIG. 12 is a sectional view of in-between the pockets.

Figure 13:
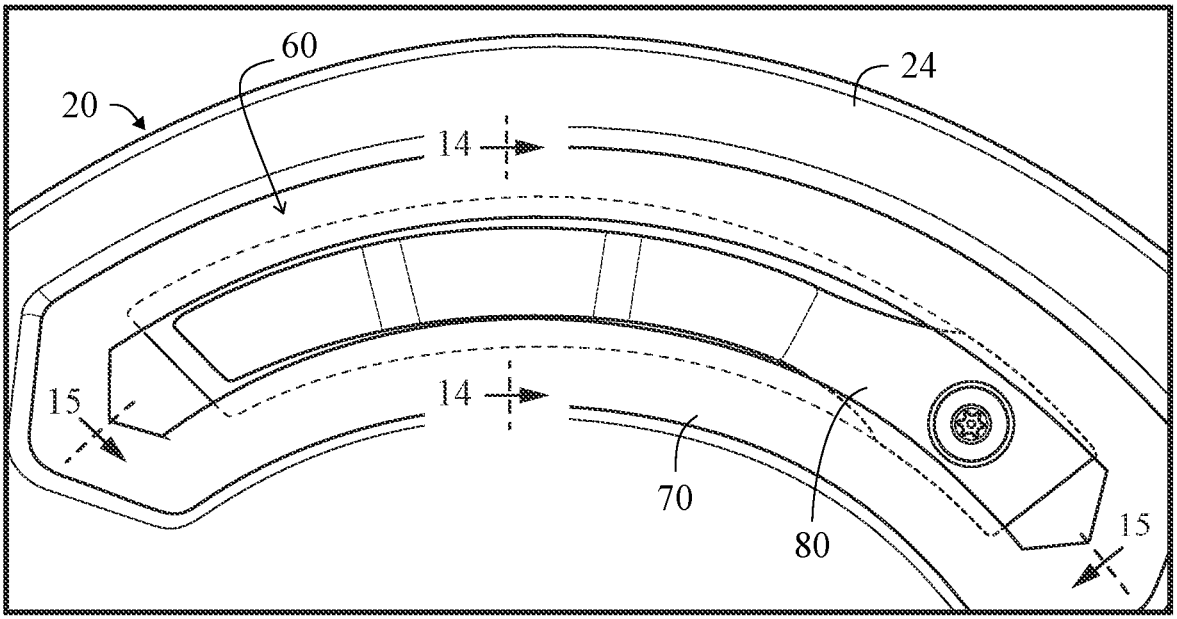
FIG. 13 is a bottom view of a golf club head with a channel and a puck with a weight therein.
Figure 14:
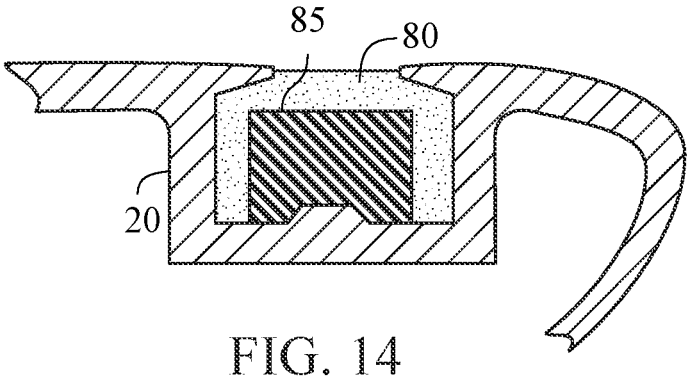
FIG. 14 is a cross-sectional view along line 14-14 of FIG. 13.
Figure 15:
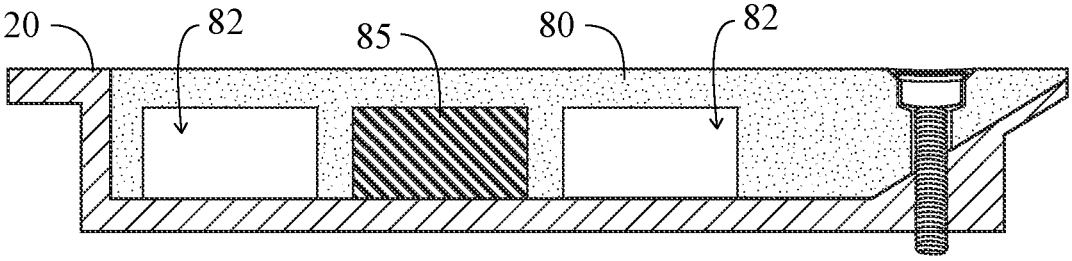
FIG. 15 is a cross-sectional view along line 15-15 of FIG. 13.

FIG. 13 is sole 24 view with a channel 60 and a puck 80 with a weight 85 therein. FIGS. 14-15 are cross-sectionals showing the weight 85 within the puck 80.

In other embodiments, the golf club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

Seluga et al., U.S. Pat. No. 9,757,629 for a Golf Club Head Having Stress Reducing Features is hereby incorporated by reference in its entirety.

Seluga et al., U.S. Pat. No. 9,776,058 for a Golf Club Head Having Optimized Ball Speed To CT Relationship is hereby incorporated by reference in its entirety.

Seluga et al., U.S. Pat. No. 11,433,281 for a Method For Manufacturing Golf Club Head Having Stress Reducing Features is hereby incorporated by reference in its entirety.

Gibbs et al., U.S. Pat. No. 11,433,282 for a Method For Manufacturing Golf Club Head Having Stress Reducing Features is hereby incorporated by reference in its entirety.

Davis et al., U.S. Pat. No. 11,400,349 for Golf Club Head With Heel And Toe Stiffeners is hereby incorporated by reference in its entirety.

Nunez et al., U.S. Pat. No. 11,364,423 for a Golf Club Head Having Stress Reducing Features is hereby incorporated by reference in its entirety.

DeMille et al., U.S. Pat. No. 11,331,544 for Binder Jet Printed Golf Club Components With Lattice Structures is hereby incorporated by reference in its entirety.

Westrum et al., U.S. Pat. No. 11,090,534 for a Golf Club Head Comprising Microscopic Bubble Material is hereby incorporated by reference in its entirety.

Frederickson, U.S. Pat. No. 11,083,939 for a Golf Club Head With Adjustable Sole Weight is hereby incorporated by reference in its entirety.

Del Rosario et al., U.S. Pat. No. 11,027,176 for a Golf Club Head With Hosel Support Structural is hereby incorporated by reference in its entirety.

Hanhart et al., U.S. Pat. No. 10,912,970 for a Golf Club Head Having Adjustable Stress Reducing Features is hereby incorporated by reference in its entirety.

Frederickson, U.S. Pat. No. 10,716,984 for a Golf Club Head With Adjustable Center Of Gravity is hereby incorporated by reference in its entirety.

DeMille et al., U.S. Pat. No. 10,105,579 for a Golf Club Head With A Compression-Molded, Thin-Walled Aft-Body is hereby incorporated by reference in its entirety.

Seluga, U.S. Pat. No. 10,099,096 for a Golf Club Head With Center Of Gravity Adjustability That Optimizes Products Of Inertia is hereby incorporated by reference in its entirety.

Seluga, U.S. Pat. No. 9,968,834 for a Golf Club Head With Adjustable Center Of Gravity is hereby incorporated by reference in its entirety.

DeMille et al., U.S. Pat. No. 9,283,447 for a Golf Club Head With Composite Face is hereby incorporated by reference in its entirety.

Griffin et al., U.S. Pat. No. 9,381,409 for a Multiple Material Iron is hereby incorporated by reference in its entirety.

DeMille et al., U.S. Pat. No. 9,387,373 for a Golf Club Head With Composite Weight Port is hereby incorporated by reference in its entirety.

Rice et al., U.S. Pat. No. 9,468,819 for a Golf Club Head is hereby incorporated by reference in its entirety.

U.S. Pat. No. 10,238,933 is hereby incorporated by reference in its entirety.

U.S. Pat. No. 9,259,627 is hereby incorporated by reference in its entirety.

U.S. Pat. No. 9,180,349 is hereby incorporated by reference in its entirety.

U.S. Pat. No. 8,834,294 is hereby incorporated by reference in its entirety.

U.S. Pat. No. 9,352,199 is hereby incorporated by reference in its entirety.

U.S. Pat. No. 9,067,110 is hereby incorporated by reference in its entirety.

U.S. Pat. No. 9,345,936 is hereby incorporated by reference in its entirety.

U.S. Pat. No. 8,956,244 is hereby incorporated by reference in its entirety

DeMille et al., U.S. Pat. No. 11,786,784 for a Golf Club Head is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications, combinations, and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A wood-type golf club head comprising:

a body comprising a face, a sole with a channel, a heel side, a toe side, and a rear side, the body composed of a titanium material, wherein the channel is located on an external surface of the sole and proximate the rear side of the body, wherein the channel has an arc shape;

a crown composed of a composite material;

a puck positioned within and filling the entire channel, the puck composed of a thermoplastic material, wherein the puck defines a pocket and wherein a weight is deposed within the pocket of the puck;

a stiffening member covering edges of the channel.

* * * * *